US007055762B2

(12) United States Patent
Gerber et al.

(10) Patent No.: US 7,055,762 B2
(45) Date of Patent: Jun. 6, 2006

(54) INJECTION VALVE WITH A CAPACITIVE VALVE LIFT SENSOR

(75) Inventors: Wolfgang Gerber, Langquaid (DE); Uwe Leuteritz, Regensburg (DE); Martin Neumaier, Regensburg (DE); Jörg Wonesch, Regensburg (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/533,812

(22) PCT Filed: Jul. 29, 2004

(86) PCT No.: PCT/EP2004/051658

§ 371 (c)(1),
(2), (4) Date: May 2, 2005

(87) PCT Pub. No.: WO2005/021958

PCT Pub. Date: Mar. 10, 2005

(65) Prior Publication Data

US 2005/0269422 A1 Dec. 8, 2005

(30) Foreign Application Priority Data

Aug. 21, 2003 (DE) ..... 103 38 489

(51) Int. Cl.
*B67D 5/08* (2006.01)

(52) U.S. Cl. ..... 239/73; 239/71; 239/102.2; 239/584; 239/585.1; 73/119 A; 123/617

(58) Field of Classification Search ..... 239/71, 239/73, 96, 102.2, 584, 533.3, 533.4, 533.9, 239/585.1; 73/119 A; 137/612, 617
See application file for complete search history.

(56) References Cited

U.S. PATENT DOCUMENTS

| | | | | |
|---|---|---|---|---|
| 3,942,366 | A * | 3/1976 | Hofmann | 73/119 A |
| 4,183,467 | A * | 1/1980 | Sheraton et al. | 239/73 |
| 4,366,706 | A * | 1/1983 | Wolff | 123/617 |
| 4,397,180 | A * | 8/1983 | Wolff et al. | 73/119 A |
| 4,414,845 | A | 11/1983 | Hofmann | |
| 4,573,349 | A * | 3/1986 | Slindee | 73/119 A |
| 6,057,692 | A | 5/2000 | Allmendinger et al. | |
| 6,637,697 | B1 | 10/2003 | Wienberg | |

FOREIGN PATENT DOCUMENTS

| | | |
|---|---|---|
| DE | 31 17 779 A1 | 11/1982 |
| DE | 34 38 048 A1 | 5/1985 |
| DE | 198 30 667 A1 | 1/2000 |
| DE | 197 51 661 C2 | 8/2000 |
| FR | 2 295 247 | 7/1976 |

* cited by examiner

*Primary Examiner*—Steven J. Ganey
(74) *Attorney, Agent, or Firm*—Laurence A. Greenberg; Werner H. Stemer; Ralph E. Locher

(57) ABSTRACT

The invention relates to an injection valve in which the movable valve parts and the valve seat (4) form the electrodes of a capacitor that is connected in an electric circuit, the capacity of said capacitor changing with the valve lift of the closing element. According to the invention, the valve seat (4) is configured in the form of an electrically conductive nozzle body (2) that is connected to the electric circuit and the closing element is configured in the form of a valve needle (5) that is connected to the electric circuit by its end surface opposite the valve seat (4).

15 Claims, 3 Drawing Sheets

INJECTION VALVE WITH A CAPACITIVE VALVE LIFT SENSOR

BACKGROUND OF THE INVENTION

Field of the Invention

The invention relates to an injection valve with a capacitive valve lift sensor for internal combustion engines.

Such an injection valve is already known from DE 198 30 667 A1.

Given the increasing number of requirements for a regulated engine injection system, it is becoming increasingly important to be able to construct a stable control system for the precise regulation of the quantity of fuel to be injected. In series operation, for example in a diesel piezo-injector with a diesel engine control system it is not possible to detect or determine the time and actual quantity of the individual injection directly with sufficient precision, only indirectly by detecting the actual movement of the valve needle in the injection valve and by calculating the injection quantity based on this.

To detect the actual movement of the valve needle, in recent years needle lift sensors have become known, which operate in a contactless manner, for example on the basis of optical elements or Hall elements. Integrating such sensors, which take up a relatively large amount of space, in a strictly dimensioned injector, in some instances in an environment with fuel pressures up to 2000 bar, is however not without its problems, even given cost considerations. Integration of a needle lift sensor also involves an increased risk of leaks.

A needle lift sensor with limited monitoring options in the form of a needle tip/valve seat contact switch is known from DE 31 17 779, the two switch positions of which are correlated to the opening and closing times of the valve needle, so that the actual injection period, although not the precise injection pattern or the actual quantity injected, can be measured. Seat contact switches also require good electrical contact between the tip of the valve needle and the valve seat in the closed position, i.e. when the valve needle meets the valve seat, while more recent endeavors have tended to aim towards reducing the significant impact loading during operation.

SUMMARY OF THE INVENTION

The object of the invention is therefore to provide a valve of the type mentioned above as an injection valve, in particular a piezo-injector, in a simple manner.

This object is achieved according to the invention by an injection valve according to claim 1. Developments and preferred measures will emerge from the subclaims.

The invention provides for an injection valve of the type mentioned above, having an electrically conductive injector body connected to the electric circuit, on which a nozzle body with a valve seat is configured, the closing element being configured as a valve needle that is connected to the electric circuit by its end surface facing away from the valve and opposite the valve seat.

The invention is based on the assumption of a valve needle, which is fully insulated from the nozzle body (housing) apart from an electric contact point on the end opposite the valve seat. The valve needle and housing form a capacitor. Movement of the valve needle changes the distance between the tip of the valve needle and the valve seat, while the distance between the needle guide and the housing remains constant. As the valve needle and the nozzle body are both electrically conductive and are separated from each other in particular by an insulating layer, they conform to the characteristics of a capacitor of changeable capacity value, the capacity being indirectly proportional to the distance between the valve seat and the tip of the valve needle. According to the invention it is possible to detect the start of movement and position during movement of the valve needle in a reproducible and documentable fashion by means of an electric signal. Said signals can be used to calculate the injection pattern and quantity injected. As a result it is possible to construct a stable control system for regulating the quantity of fuel to be injected for series operation.

For further mechanical and electrical provision, it is advantageous according to a first embodiment of the invention for the voltage interface of the capacitor electric circuit to be achieved via a conductor, which is guided in an insulated fashion in an axial hole in the injector body and which is connected to an electrically conductive contact spring arranged in an insulated fashion in the injector body, said spring being supported in a manner such that contact is established on the bottom of the head of a conductive injector piston, which is pressed in a manner such that contact is established against the end surface of the valve needle facing away from the valve. More specifically it is advantageous with this embodiment for the injector body to be configured as an intermediate disk above the end surface of the valve needle facing away from the valve and for an electrically conductive contact element to be provided on the side of the intermediate disk facing away from the valve to establish an electrical connection between the conductor and the contact spring, said contact element being electrically insulated from the injector body and the intermediate disk, with the valve-side end of the contact spring supported on it. It is also advantageous for a seal to be provided at both the start and end of the axial hole.

According to a second embodiment of the invention it is advantageous to pass the capacitor electric circuit via a nozzle retaining spring arranged in an electrically insulated fashion in the injector body, said spring pressing the valve needle against the valve seat, the end of the nozzle retaining spring facing away from the valve being supported on an adjusting disk, which is connected electrically to a terminal with further connections and being supported on the valve side on a conductive injector piston, which is pressed in a manner such that contact is established against the end surface of the valve needle facing away from the valve.

With this embodiment the electrical insulation can be ensured or improved in a simple fashion, in that the valve needle and injector piston in particular have an insulating layer at least on a part of the surfaces which do not serve to establish contact.

In respect of the electrical decoupling of movable valve parts or areas of the injection valve on the valve side from the capacitor, it is particularly advantageous to provide a control piston, the valve-side end surface of which presses onto the central area of the head surface of the injector piston facing away from the valve, an insulating layer being provided at the same time on the head surface of the injector piston.

Within existing injector structures the capacitive valve lift sensor can be integrated in a favorable manner by configuring the injector body as an intermediate disk above the end surface of the valve needle facing away from the valve and by configuring an axial annular collar on the end surface of the valve needle, to which a counter-collar configured on the bottom of the intermediate disk is assigned as a stop surface, it being possible to provide the bottom of the intermediate disk with an insulating layer at least in the area of the stop surface.

With a view to preventing leakage flow and corrosion, it is favorable for it to be possible to determine the valve lift present by measuring the voltage drop $U_{inj}$ in each instance at the valve seat ($R_2$+$C_{var}$), an alternating voltage being applied as the operating voltage $U_B$. The change in the complex resistance $R_2$+$C_{var}$ is thereby measured in a predefined time window in order to determine the position of the nozzle needle or the valve lift.

The insulating layers can preferably be configured, at least in places, as a diamond-like carbon (DLC) or aluminum oxide or zircon oxynitrite layer, which is characterized by a high level of abrasion resistance and impact resistance in addition to its insulating characteristics, and does not inhibit the movement of the corresponding parts by friction.

The valve lift H present of the nozzle needle can be determined by measuring the voltage drop at the complex resistance $R_2$+$C_{var}$, an alternating voltage being applied as the operating voltage $U_B$ and the complex resistance being formed essentially between the nozzle needle and the nozzle body.

The axial position of the nozzle needle is a function of the capacity determined and the resistance between the injector body and at least one valve part.

The time when the nozzle needle lifts off the valve seat is a function of the change in capacity determined between the nozzle needle and the nozzle body and can in particular be detected by the determined capacity reduction.

The rate of wear of the insulating layer between the nozzle needle and the nozzle body is a function of the ohmic resistance determined between the nozzle needle and the nozzle body, a reduction in resistance ($R_2$) preferably being associated with increased wear.

The inside of the nozzle body and the nozzle needle are thereby coated at least in the region of the valve seat.

Further advantages and embodiments of the invention are described below with reference to the exemplary embodiment shown in the figures in the drawing, in which:

DESCRIPTION OF THE PREFERRED EMBODIMENTS

Figure 1:
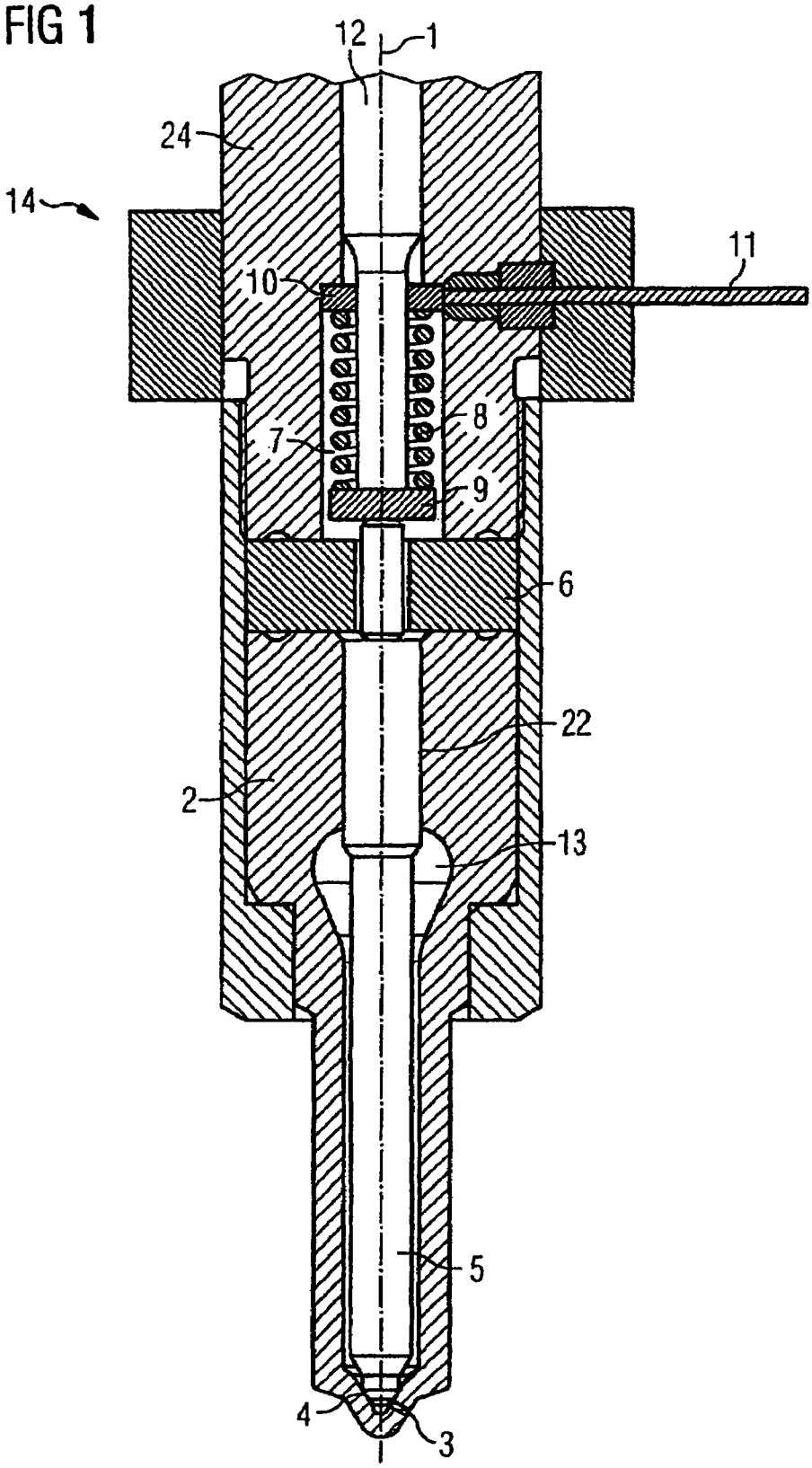
FIG. 1 shows a schematic diagram of a longitudinal section through the nozzle-side part of an injection valve according to the invention.

FIG. 1 shows a longitudinal section for exemplary purposes of a piezo-electrically operated injection valve, which can be connected, together with other piezo-injectors, in a manner known per se to a central common rail (not shown) for diesel fuel and which is activated electrically by means of an external control unit (ECU). The piezo-actuator itself is generally located in the upper part of the injector body 14 (not shown here).

The lower part of the injection valve shown is primarily made of electrically conductive materials and is preferably configured with rotational symmetry in respect of the valve axis 1. It has a nozzle head 2, on the nozzle opening 3 of which a valve seat 4 is configured, on which a valve needle 5 rests. The upper section (larger in cross section) of the valve needle 5 passes tightly through the nozzle body 2, an insulating layer 22, in each instance an abrasion resistant and low-friction insulation, being provided between this section of the valve needle 5 and the nozzle body 2. At the point of transition from the upper to the lower section (narrower in cross section) of the valve needle 5, there is a high-pressure chamber 13 supplied with fuel (via a line that is not shown). Fuel can be fed from this chamber 13 along the valve needle 5, via the valve seat 4, to the nozzle opening 3. As a result there is generally adequate electrical insulation from the nozzle body 2 along the lower section of the valve needle 5.

The upper end surface of the valve needle 5 is adjacent to an intermediate disk 6, which, together with the tight passage of the valve needle 5, in this embodiment separates a valve-side high-pressure area of the fuel injection valve from a low-pressure area above it and which is connected in a conductive fashion to the further areas of the nozzle body 2 or the injector body 14 above and below. Above the intermediate disk 6 a spring space 7 open at the front is recessed in the injector body 14, in which space 7 a nozzle retaining spring 8 is arranged. The bottom of the nozzle retaining spring 8 is supported on the top of an injector piston 9 configured as a T-piece, which is passed through a hole in the intermediate piece 6 and the bottom of which presses against the upper end surface of the valve needle 5. At the other end the nozzle retaining spring 8 is supported on an adjusting disk 10 that is arranged so that it is insulated from the injector body 14, said adjusting disk 10 being connected electrically to a terminal contact 11 that is insulated from the injector body 14 via a hole leading outward.

A control piston 12 is passed axially through the nozzle retaining spring 8, one end surface pressing on the top of the injector piston 9 and the other end projecting into the upper part of the injection valve.

The mode of operation of this structure, the mechanical and hydraulic aspects of which are known per se, are based on the fact that as long as the injector is not activated, the high fuel pressure is present both at the tip of the valve needle 5 and in a control space arranged at the upper end surface of the control piston 12 but is manifested there due to the larger surface by a larger active compression force and therefore closes the valve. If the injector is activated, the extended piezo-actuator opens a fuel return from the control space, as a result of which the pressure at the tip of the valve needle 5 increases, pushes the valve needle 5 upwards and opens the nozzle valve. Other embodiments are however also essentially possible according to the invention, in which there is a flow through a piezo-actuator or a solenoid valve when the valve closes.

As shown in FIG. 1, the cross-section of the upper section of the valve needle 5 is somewhat larger than the cross-section of the hole provided for the injector piston 9 in the intermediate disk 6. An axial annular collar is thereby formed on the upper end surface of the valve needle 5, to which a counter-collar configured on the bottom of the intermediate disk 6 is assigned as a stop surface.

Figure 2:
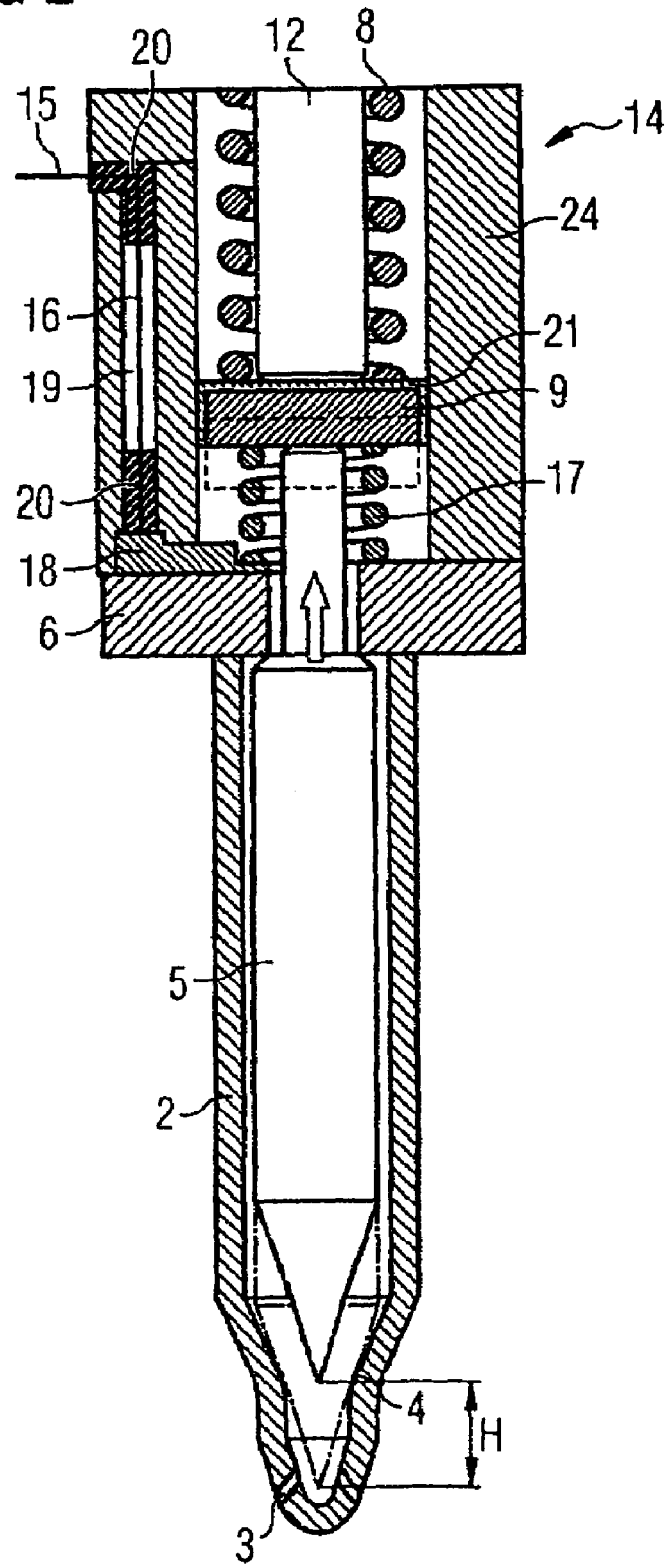
FIG. 2 shows another embodiment of an injection valve according to the invention as shown in FIG. 1.

FIG. 2 shows an embodiment of the injection valve according to the invention, which differs in the manner of contact from the embodiment shown in FIG. 1. As shown, the voltage interface is achieved via a terminal 15 and an axial hole 19 in the injector body 14, through which an insulated conductor (wire) 16 is passed. An electrically conductive contact element 18 is fashioned in the side of the intermediate disk (stop disk) 6 facing away from the valve and is insulated electrically from the intermediate disk 8 and the injector body 14, e.g. by means of an insulating insert, and has a permanent electrical connection to the conductor 16. An electrically conductive contact spring 17 is supported on the contact element 18, with its other end supported on the bottom of the head of the injector piston 9, thus passing the voltage on to the injector piston 9. The injector piston 9 is provided with an electrically insulating layer 21 separating it from the control piston 12 at the head surface and side surfaces of the head for electrical decoupling and to reduce parasitic capacity. The voltage is passed via the valve-side end of the lift adjustment pin 9 to the valve needle 5 (which has lateral insulation from the nozzle body 2). Advantages of this contact variant are simpler integration in the engine space and the possibility of moving the terminal 15 further upward in the injection valve, thereby in particular establishing an electrical interface with the plug connector of the piezo-actuator. The hole 19 should be sealed, as shown, from the inside out and from the outside in by means of a seal 20, to prevent penetration of external materials or pressure loss.

The nozzle needle 5 and the injector body 14 (housing) of the injection valve described form a capacitor connected in an electric circuit, which acts as a capacitive valve lift sensor as follows:

To obtain an electrical signal corresponding to the position of the valve needle 5 and the associated valve lift H, the nozzle body 2 is brought to earth potential and the terminal contact 11 is connected to a voltage source $U_B$ via a preliminary resistance $R_{vor}$. With this circuit arrangement shown in FIG. 3, the voltage drop $U_{inj}$ is measured directly at $R_2+C_{var}$ and used for evaluation, e.g. in the context of a central control unit (ECU). The voltage $U_B$ is supplied to the adjusting disk 10 of the nozzle retaining spring 8 or the terminal 15 and, depending on the contact variant, passed on to the valve needle 5. It should be ensured that all the current-carrying parts apart from the contact points are insulated sufficiently from the nozzle body 2. This is ensured by a sputtered diamond-like carbon (DLC) or aluminum oxide or zircon oxynitrite layer, which has both good abrasion resistance and low electrical conductivity and is therefore suitable as an insulating layer even if leakage flow cannot be excluded. An insulating layer must be provided in particular at the points of the adjusting disk 10 and the lift adjustment pin 9, at which the nozzle body 2 narrows. It is also advantageous if this insulating layer also has a very low coefficient of friction, ensuring good performance of the moving parts.

Figure 3:
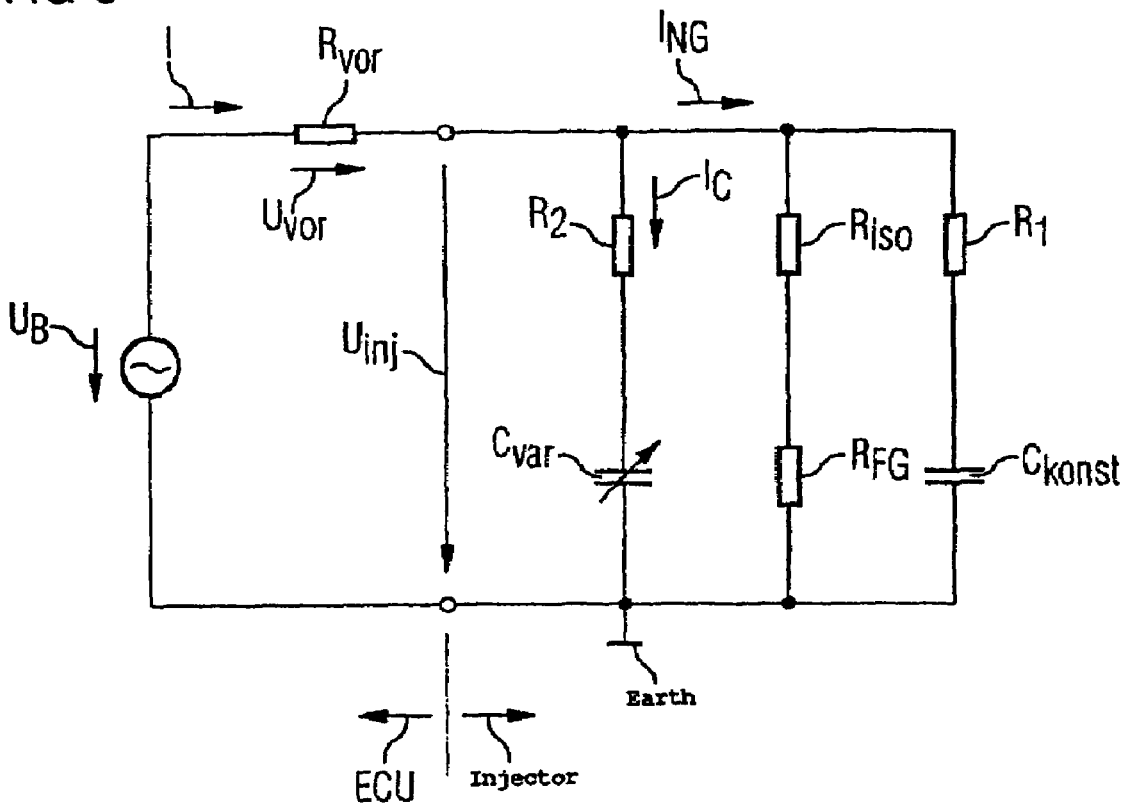
FIG. 3 shows an equivalent circuit diagram of the capacitor electric circuit used for the capacitive determination of valve lift.

The equivalent circuit diagram shown in FIG. 3 also clarifies the resistance conditions in the injector and shows the simple structure of the measuring circuit with the voltage source $U_B$, the capacitor $C_{var}$ and the resistance $R_{vor}$ connected in series with $C_{var}$. $R_2$ is the ohmic resistance element, $C_{var}$ the corresponding capacitive blind element between the nozzle needle and the valve seat. $R_{ISO}$ refers to the insulation resistance of the insulating layer and $R_{FG}$ the transition resistance between the passage of the valve needle 5 and the nozzle body 2. $R_2 << (R_{ISO}+R_{FG})$ thereby applies. $C_{var}$ and $R_2$ essentially represent the complex resistance between the valve seat, represented by the nozzle needle tip 4 and the associated inside of the nozzle body 2.

To prevent corrosion due to contact erosion and/or contact surfaces open to galvanic processes and as leakage streams are to be expected at the insulating layers, the operating voltage $U_B$ is designed as an alternating voltage.

The overall lift of the valve needle 5 can for example be 100–250 μm. Apart from measurement of the voltage drop $U_{inj}$ described above, electrical evaluation can also take place according to a different electrical principle or even in combination with an appropriate coil by detuning the resonance frequency.

During electrical evaluation it must be taken into account that the relatively small capacity changes to be measured contrast with a large overall capacity—also the result of capacities connected in parallel, see $C_{konst}$ and associated $R_1$ in FIG. 3. It is therefore advantageous to reduce the overall capacity in particular by inserting an insulating layer between the lower end surface of the control piston 12 and the upper end surface of the injector piston 9, reducing the overall capacity by connecting sub-capacities in series.

According to the invention it is possible with relatively simple means, in particular without major mechanical outlay, to detect the position of the valve needle 5 directly. A control chain can then be established from this, using the measured values to deduce the actual quantity injected via a few calculation stages, comparing this with the target values predefined for the mode of operation and adjusting the activation parameters correspondingly based on an evaluation of the differences.

We claim:

1. An injection valve with a capacitive valve lift sensor for an internal combustion engine, the valve comprising:

a nozzle body formed with a valve seat;

a valve needle longitudinally guided in and electrically insulated from said nozzle body, said valve needle having a first end assigned to said valve seat and a second end;

said valve needle and said valve seat forming respective electrodes of a capacitor connected in an electric circuit, said capacitor having a capacitance varying with a valve lift of said valve needle; and an electrically conductive injector body connected to said electric circuit and carrying said nozzle body with said valve seat, and wherein said second end of said valve needle is connected to said electric circuit;

said electric circuit having a voltage interface via a conductor passed in an insulated fashion in an axial hole formed in said injector body, said conductor being connected to an electrically conductive contact spring disposed in an insulated fashion in said injector body, said contact spring being supported such that contact is established on a bottom of a head of a conductive injector piston, being pressed for establishing contact against said second end surface of said valve needle facing away from said valve seat.

2. The injection valve according to claim 1, wherein said injector body is configured as an intermediate disk above an end surface of said valve needle facing away from said valve seat and wherein an electrically conductive contact element is disposed on a side of said intermediate disk facing away from said valve seat for an electrical connection between said conductor and said contact spring, said contact element is electrically insulated from said injector body and said intermediate disk, and a valve-side end of said contact spring is supported on said contact element.

3. The injection valve according to claim 1, which comprises a seal at a start and an end of said axial hole.

4. The injection valve according to claim 1, wherein said valve needle and said injector piston are formed with an insulating layer at least on part of surfaces thereof that do not serve to establish contact.

5. The injection valve according to claim 4, wherein said electrically insulating layer is formed of a material selected from the group consisting of diamond-like carbon, aluminum oxide, and zirconium oxynitrite.

6. The injection valve according to claim 1, wherein an actual valve lift (H) is determined by measuring a voltage drop $U_{inj}$ in each instance at a complex resistance substantially formed between said nozzle needle and said nozzle body, and an alternating voltage is applied as an operating voltage $U_B$.

7. The injection valve according to claim 6, wherein a time when said nozzle needle lifts off said valve seat depends on a change in capacitance between said nozzle needle and said nozzle body.

8. The injection valve according to claim 6, wherein a time when said nozzle needle lifts off said valve seat depends on a change in capacitance between said nozzle needle and said nozzle body and is detectable by a determined capacitance reduction.

9. The injection valve according to claim 1, wherein an axial position of said nozzle needle is a function of a determined capacitance and resistance between said injector body and at least one valve part.

10. The injection valve according to claim 1, wherein a wear rate of an insulating layer between said nozzle needle and said nozzle body is a function of an ohmic resistance determined between said nozzle needle and said nozzle body.

11. The injection valve according to claim 10, wherein increased wear of the insulating layer between said nozzle needle and said nozzle body is indicated by a reduced ohmic resistance between said nozzle needle and said nozzle body.

12. An injection valve with a capacitive valve lift sensor for an internal combustion engine, the valve comprising:

a nozzle body formed with a valve seat;

a valve needle longitudinally guided in and electrically insulated from said nozzle body, said valve needle having a first end associated with said valve seat and a second end;

said valve needle and said valve seat forming respective electrodes of a capacitor connected in an electric circuit, said capacitor having a capacitance varying with a valve lift of said valve needle; and an electrically conductive injector body connected to said electric circuit and carrying said nozzle body with said valve seat, and said second end of said valve needle being connected to said electric circuit;

said electric circuit passing via a nozzle retaining spring disposed in an electrically insulated fashion in said injector body, said nozzle retaining spring pressing said valve needle against said valve seat, an end of said nozzle retaining spring facing away from the valve seat being supported on an adjusting disk, said adjusting disk being connected electrically to a terminal with further connections, and being supported on a valve side thereof on a conductive injector piston pressed such that contact is established against said second end surface of said valve needle.

13. The injection valve according to claim 12, which further comprises a control piston having a valve-side end surface pressing on a central region of a head surface of said injector piston facing away from said valve seat, and an insulating layer disposed on a head surface of a lift adjustment pin.

14. The injection valve according to claim 13, wherein an inside of said nozzle body and said nozzle needle are coated with a further insulating layer at least in a region of said valve seat.

15. An injection valve with a capacitive valve lift sensor for an internal combustion engine, the valve comprising:

a nozzle body formed with a valve seat;

a valve needle longitudinally guided in and electrically insulated from said nozzle body, said valve needle having a first end associated with said valve seat and a second end;

said valve needle and said valve seat forming respective electrodes of a capacitor connected in an electric circuit, said capacitor having a capacitance varying with a valve lift of said valve needle; and an electrically conductive injector body connected to said electric circuit and carrying said nozzle body with said valve seat, and said second end of said valve needle being connected to said electric circuit, said injector body being configured as an intermediate disk above said second end surface of said valve needle and an axial annular collar being configured on the end surf ace of said valve needle, and a stop surface formed as a counter-collar configured on a bottom of said intermediate disk, and wherein the bottom of said intermediate disk is formed with an insulating layer at least in an area of said stop surface.

* * * * *